US012076634B2

(12) United States Patent
Kyser

(10) Patent No.: US 12,076,634 B2
(45) Date of Patent: Sep. 3, 2024

(54) CURB COVER APPARATUS AND SYSTEMS DIRECTED THERETO

(71) Applicant: Matthew Kyser, Irvine, CA (US)

(72) Inventor: Matthew Kyser, Irvine, CA (US)

( * ) Notice: Subject to any disclaimer, the term of this patent is extended or adjusted under 35 U.S.C. 154(b) by 0 days.

(21) Appl. No.: 17/701,651

(22) Filed: Mar. 22, 2022

(65) Prior Publication Data

US 2022/0305366 A1 Sep. 29, 2022

Related U.S. Application Data

(60) Provisional application No. 63/291,940, filed on Dec. 30, 2021, provisional application No. 63/283,200, filed on Nov. 24, 2021, provisional application No. 63/241,413, filed on Sep. 7, 2021, provisional application No. 63/182,657, filed on Apr. 30, 2021, provisional application No. 63/165,061, filed on Mar. 23, 2021.

(51) Int. Cl.
*A63C 19/12* (2006.01)
*E04F 19/02* (2006.01)

(52) U.S. Cl.
CPC ..... *A63C 19/12* (2013.01); *E04F 19/026* (2013.01); *E04F 19/028* (2013.01)

(58) Field of Classification Search
CPC ..... A63C 19/12; E04F 19/026; E04F 19/028
See application file for complete search history.

(56) References Cited

U.S. PATENT DOCUMENTS 6,648,805 B1 * 11/2003 Millis ..... A63B 69/0022 482/141
7,048,634 B1 * 5/2006 Fernandez ..... A63C 19/10 472/89
7,273,443 B1 * 9/2007 Martinez ..... A63B 69/0093 482/38

(Continued)

FOREIGN PATENT DOCUMENTS

GB 2463287 A 3/2010
WO WO-0244068 A2 * 6/2002 ..... B66B 31/00

OTHER PUBLICATIONS

Brown-Campbell, "Bar greating steel curb angles." <https://www.brown-campbell.com/development/products/info/bar-grating/bar-grating-steel-curb-angles> last accessed Apr. 4, 2022.

(Continued)

*Primary Examiner* — Adriana Figueroa
(74) *Attorney, Agent, or Firm* — Rutan & Tucker, LLP; Kyle M. St. James

(57) ABSTRACT

An apparatus for providing protection to a curb or a ledge against damage caused by physical contact to the curb or the ledge during performance of a sporting activity is disclosed. The apparatus includes a top component and a side component extending from the top component at an angle within an angle range of 60°-90°, wherein the top component and the side component are formed of steel, wherein the top component and side component are configured to be placed on the curb or the ledge. In some instances, the top component and the side component are integrally formed from a single sheet of 14 gauge cold-rolled steel, and wherein a bend is formed in the single sheet of steel to form the angle between the top component and side component. In some instances, the angle is 75° or 90°.

20 Claims, 13 Drawing Sheets

(56) References Cited

U.S. PATENT DOCUMENTS

| | | | | |
|---|---|---|---|---|
| 2002/0027224 | A1 | 3/2002 | Labelson | |
| 2003/0196308 | A1 * | 10/2003 | Kelsey | A63C 19/10 29/426.3 |

OTHER PUBLICATIONS

City of Sacramento, "Transportation sepcification drawings." <https://www.cityofsacramento.org/-/media/Corporate/Files/DOU/Specs-Drawings/Transportation.pdf?la=en> last accessed Apr. 4, 2022.
PCT/US2022/033855 filed Jun. 16, 2022 International Search Report and Written Opinion dated Oct. 19, 2022.

* cited by examiner

CURB COVER APPARATUS AND SYSTEMS DIRECTED THERETO

CROSS-REFERENCE FOR RELATED APPLICATIONS

This application claims the benefit of priority on U.S. Provisional Patent Application No. 63/165,061 filed Mar. 23, 2021, U.S. Provisional Patent Application No. 63/182,657, filed Apr. 30, 2021, U.S. Provisional Patent Application No. 63/241,413, filed Sep. 7, 2021, U.S. Provisional Application No. 63/283,200, filed Nov. 24, 2021, and U.S. Provisional Application No. 63/291,940, filed Dec. 30, 2021, the entire contents of which are incorporated by reference herein.

FIELD

Embodiments of the disclosure relate to the field of sporting equipment. More specifically, one embodiment of the disclosure is directed to an apparatus for covering a curb or other curved surface to protect the curb or other curved surface during sporting activities. Further, one specific embodiment of the disclosure is directed to a metal apparatus having a predetermined length and two connected sides that form a cover to be placed on a sidewalk curb and protect the sidewalk curb during sporting activities such as skateboarding, rollerblading or scootering.

GENERAL BACKGROUND

Action sports, such as skating, rollerblading, scootering, and bicycling, are often performed in areas such as parking lots, walkways or streets in addition to dedicated areas such as skateparks. Many riders desire to perform tricks that involve contact with surfaces such as curbs, ledges, and curb stops. In some instances, skateboarders (or riders) may navigate to a ledge or curb and perform an "ollie" whereby a rider leaps into the air causing the skateboard to follow. The rider may land on the skateboard while the skateboard lands on the ledge or curb. A similar feat may be performed by a rider using roller blades, a scooter, or a bicycle. Countless other tricks may be performed requiring contact between a skateboard, roller blades or skates, a scooter, or a bicycle.

As should be understood, repeated use of a portion of a ledge or curb for the above-described actions often results in damage to the ledge or curb. As these areas are typically public property, such actions may be considered unfavorable by some in the community. In particular, sidewalk curbs are often cracked or chipped as a result of individuals riding, grinding, or otherwise directly contacting a portion of the curb. Additionally, individuals may place substances (e.g., wax) on the curb to decrease the friction between skateboards, rollerblades, scooters, which allows for an individual to more easily carry out various tricks that involve directly contacting the curb.

Neither damage to the curb (or other areas, e.g., a ledge or parking block) nor the placement of substances such as wax on the curb are desirable by others. For instance, damage to the curb or other areas may be dangerous and increase the likelihood that someone falls or slips due to a crack, chip, etc. Similarly, as substances such as wax decrease the friction created when contacting the curb or other area, the presence of the substances increases the likelihood someone may slip and fall. Thus, what is needed is an apparatus to protect surfaces such as ledges, curbs, and curb stops during sporting activities such as skateboarding, rollerblading or scootering.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

Finally, the terms "or" and "and/or" as used herein are to be interpreted as inclusive or meaning any one or any combination. As an example, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure is to be considered as an example of the principles of the invention and not intended to limit the invention to the specific embodiments shown and described. The invention may include additional components not explicitly described above and/or variations thereof that will become apparent throughout the description below and in view of the corresponding figures.

II. Solid Curb Cover Apparatus

Figure 1A:
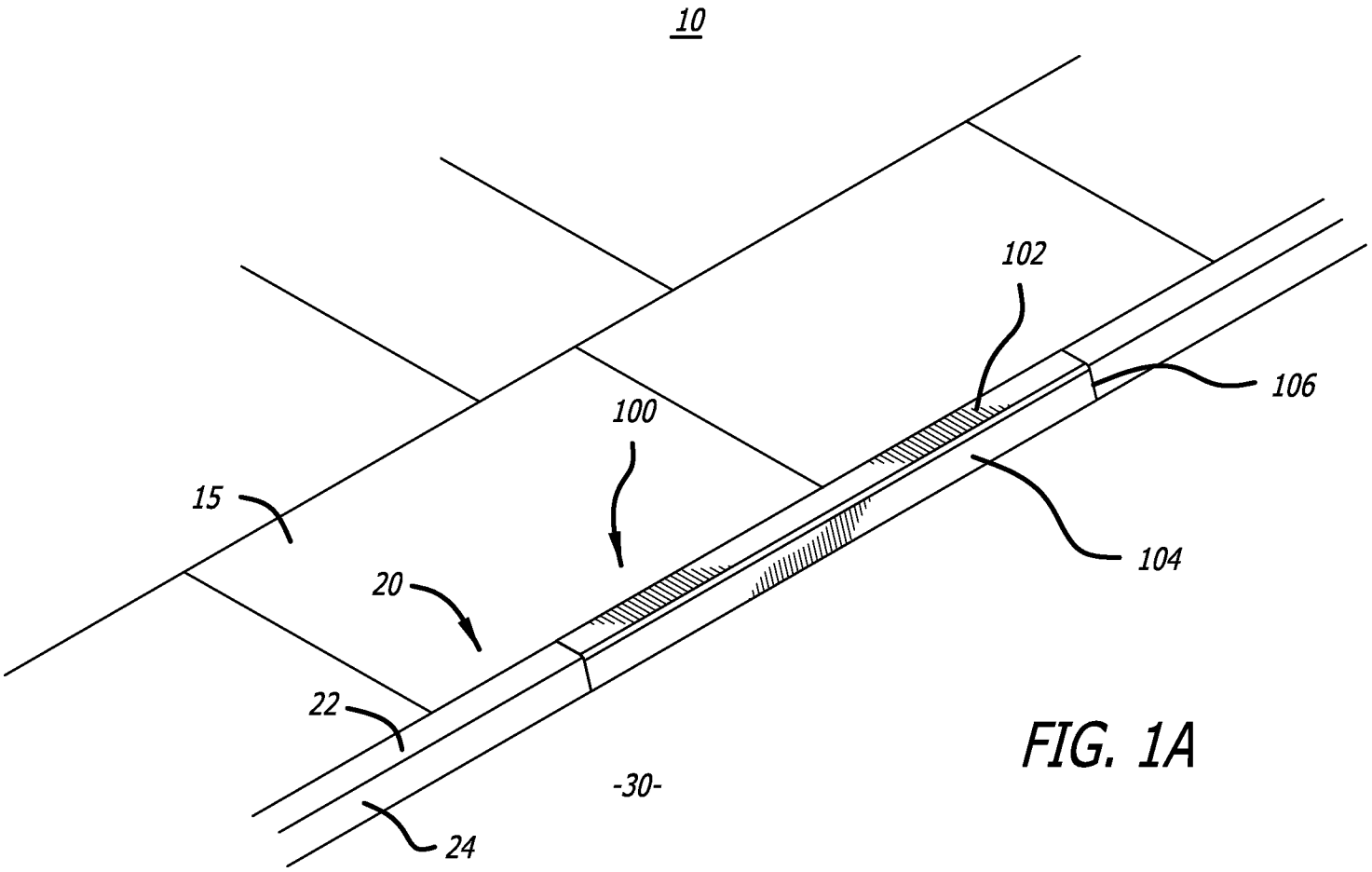
FIG. 1A is a perspective view of an embodiment of a solid curb cover apparatus disposed on a sidewalk curb and configured to protect the sidewalk curb from damage in accordance with some embodiments.

Referring now to FIG. 1A, a first elevation view of an embodiment of a solid curb cover apparatus disposed on a sidewalk curb and configured to protect the sidewalk curb from damage is shown in accordance with some embodiments. The solid curb cover apparatus ("curb cover") 100 is shown in an environment 10 that includes a sidewalk 15 and a street 30. As is known, the sidewalk 15 includes a curb 20, which includes a top 22 and a front 24. The curb cover 100 is specifically configured to be placed on the curb 20 and cover a portion of the top 22 and the front 24.

The curb cover 100 includes a top component 102, a front component 104 and a bend (or corner) component 106. Each of the components 102, 104, 106 include an upper side (surface or face) that is exterior facing and an underside (surface or face) that is curb facing. In some embodiments, the curb cover 100 is formed of 14 gauge cold-rolled steel. Additionally, in some embodiments, the curb cover 100 is galvanized to protect the apparatus from rusting. In some embodiments, a powder coating finish may be applied to the curb cover 100, which further reduces the coefficient of friction while providing a visually distinct appearance. In some embodiments, the curb cover 100 may have a length that falls within the range of 48.00-108.00 inches. In some embodiments, the length falls with the range of 84.00-96.00 inches, with one particular embodiment being a length of 92.00 inches.

The curb cover 100 may be integrally formed as a single piece of steel. In other embodiments, the curb cover 100 may be formed of multiple pieces of steel (corresponding to each of the top component 102, the front component 104, and the bend component 106) welded together. In alternative embodiments, other materials may be utilized, such as high-density polyethylene (HDPE) or polyethylene high-density (PEHD) (e.g., a thermoplastic polymer made from petroleum).

As noted above, many action sports such as skateboarding, scootering, and roller skating are performed in public commercial and residential settings (such as on public streets, sidewalks, walkways, parking lots, etc.) in addition to dedicated areas such as skateparks. Further, it is well-known that performance of such activities often results in damage to various portions of these areas, especially commercial and residential areas. In particular, sidewalk curbs are often cracked or chipped as a result of individuals riding, grinding, or otherwise directly contacting a portion of the curb. Additionally, individuals may place substances (e.g., wax) on the curb to decrease the friction between skateboards, rollerblades, scooters, which allows for an individual to more easily carry out various tricks that involve directly contacting the curb.

Neither damage to the curb (or other areas, e.g., a ledge or parking block) nor the placement of substances such as wax on the curb are desirable by others. For instance, damage to the curb or other areas may be dangerous and increase the likelihood that someone falls or slips due to a crack, chip, etc. Similarly, as substances such as wax decrease the friction created when contacting the curb or other area, the presence of the substances increases the likelihood someone may slip and fall. As a result, the curb cover 100 provides numerous advantages. First, the curb cover 100 protects of the curb itself. Second, the curb cover 100 removes the need for individuals to apply substances such as wax to the curb as the metal from which the curb cover 100 is manufactured provides an improved sliding, grinding, or skating surface as compared to the curb itself. Third, the curb cover 100 is a temporary structure and may be moved with ease and, as a result, leaves no hazard (damage or slippery substance) on the curb for individuals to fall or slip on at a later time.

Additionally, the curb cover 100 provides several benefits to the individuals using the curb cover 100 while taking part in the skating or scootering. For instance, the curb cover 100 provides a smooth, slick, and consistent surface. Thus, as a first benefit, skaters or individuals riding a scooter are able to perform movements (e.g., tricks that involve grinding or sliding on the curb cover) without the concern of catching their board, scooter, or rollerblades on a dent, crack, chip, etc., in the curb. As a result, the rider has increased confidence in his/her ability to perform the desired movement. As a second benefit, the curb cover 100 provides a surface having a lower coefficient of friction than the surface of the curb. As a result, riders are more easily able to complete movements that involve directly contacting the curb cover 100 surface as opposed to the curb surface (e.g., a board, a scooter, or rollerblades will slide further and faster due to the lower coefficient of friction).

Figure 1B:
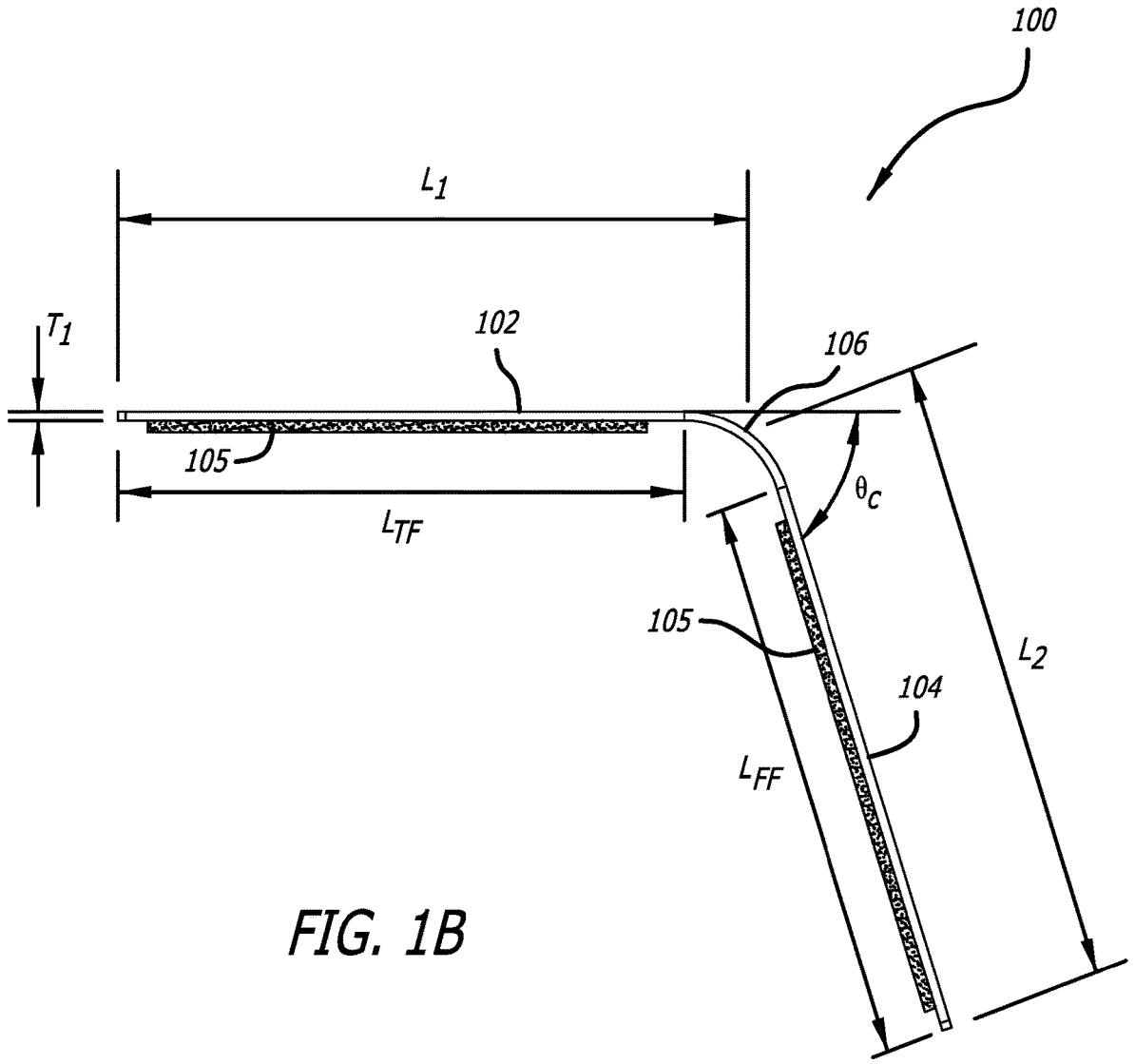
FIG. 1B is a first elevation view of the curb cover apparatus of FIG. 1A in accordance with some embodiments.

Referring now to FIG. 1B, a second elevation view of the curb cover apparatus of FIG. 1A is shown in accordance with some embodiments. A first length (L1) may be defined from the outer most edge of the top component 102 to a center of the bend component 106, and a second length (L2) may be defined from the outer most edge of the front component 104 to the center of the bend component 106. In some embodiments, the first and second lengths may be the same. In some embodiments, the first and second lengths may fall within the range of 3.00-6.00 inches. In one embodiment, the first and second lengths may each be 5.00 inches. However, in other embodiments, the first and second lengths may differ.

Further, front component 104 is positioned at a first angle relative to the top component ($\theta_C$). The angle of a curb may vary slightly depending on the location of the curb, as government agencies or other organizations, e.g., townships, municipalities, housing associations, cities, states, countries, etc., may determine an angle of the curb (e.g., the top component relative to the front component). In many cases, the angle ranges from 60°-85°. Thus, the first angle relative ($\theta_C$) may be within the ranges from 60°-85°. In some embodiments, the range may be 70°-75°, with one embodiment the first angle relative ($\theta_C$) being 75°. Further, the top component 102, the front component 104, and the bend component 106 may have the same thickness (T1), which may fall within the range of 0.05-1 inch, with one particular embodiment being 0.074 inches.

In some embodiments, the underside of the curb cover 100 may include protective pads 105 adhesively attached thereto. These pads may assist in vibration and noise isolation when an object (e.g., skateboard, scooter, roller skates, bicycle, or any accessories attached thereto) contacts the exterior facing side of the curb cover 100. The protective pads 105 may be comprised of material such as, but limited or restricted to, textile materials (e.g., from natural fibers such as wool or synthetic fibers such as petroleum-based acrylic or acrylonitrile, or wood pulp-based rayon), or rubber.

Figure 1C:
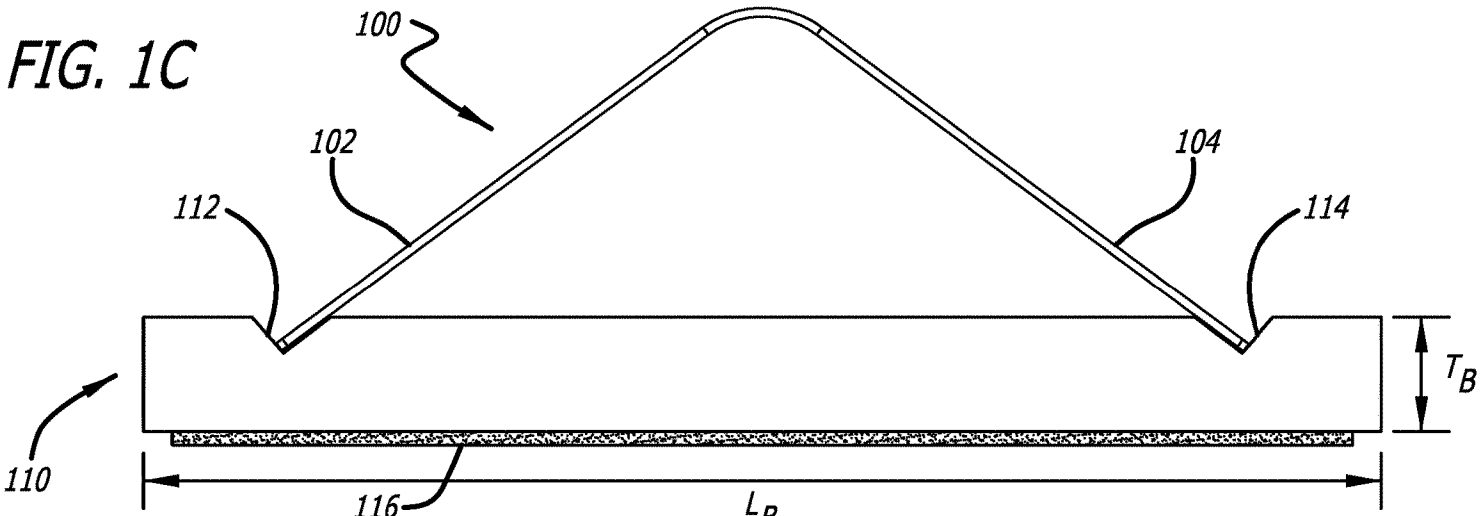
FIG. 1C is a second elevation view of the curb cover apparatus of FIG. 1A disposed in a base in accordance with some embodiments.

Referring now to FIG. 1C, a second elevation view of the curb cover apparatus of FIG. 1A disposed in a base is shown in accordance with some embodiments. The base 110 provides a stand for which to place the curb cover 100. The base 110 may be used as an alternative to placing the curb cover 100 on a curb (e.g., in an event a curb is not present, or utilization is desired elsewhere such as in the middle of a road, parking lot, or other area). The base 110 includes grooves 112, 114 specifically configured to receive the curb cover 100 (e.g., the angle of the grooves 112, 114 corresponds to the components 102, 104 based on the angle ($\theta_C$) of the curb cover 100. The base 110 may have a thickness (TB) that falls within the range of 0.25-1.00 inch, with one particular embodiment being 0.25 inches. The grooves 112, 114 may have a depth falling within the range of 0.125-0.25 inches, with one particular embodiment being 0.125 inches.

In some embodiments, the underside of the base 110 may include one or more protective pad 116 adhesively attached thereto. The protective pads 116 may assist in vibration and noise isolation when an object (e.g., skateboard, scooter, roller skates, bicycle, or any accessories attached thereto) contacts the exterior facing side of the curb cover 100. The protective pad(s) 116 may be comprised of material such as, but limited or restricted to, textile materials (e.g., from natural fibers such as wool or synthetic fibers such as petroleum-based acrylic or acrylonitrile, or wood pulp-based rayon), or rubber.

Figure 1D:
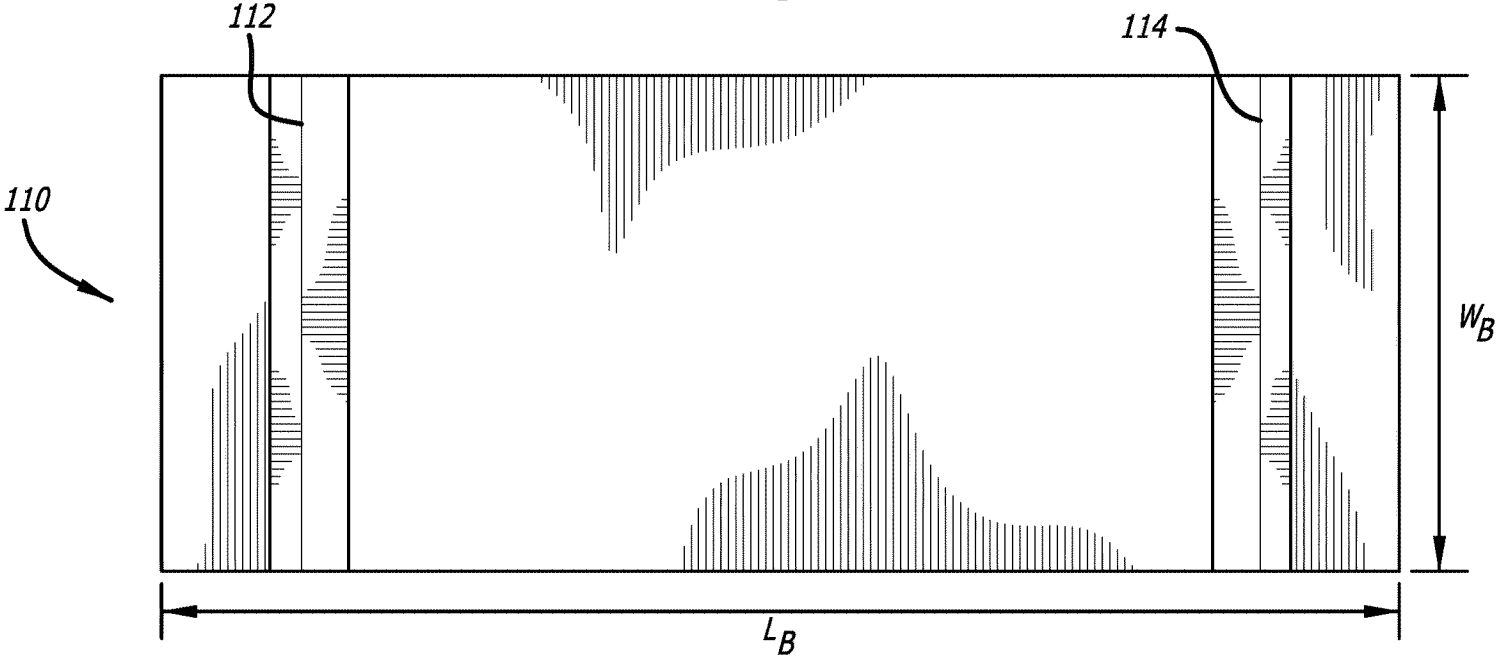
FIG. 1D is a top plan view of the base of FIG. 1C is shown in accordance with some embodiments.

Referring now to FIG. 1D, a top plan view of the base of FIG. 1C is shown in accordance with some embodiments. In some embodiments, the base 110 may have a length (LB) that falls within the range of 10.00-16.00 inches, with one particular embodiment being 12.00 inches. The base 110 may have a width (LB) that falls within the range of 10.00-16.00 inches, with one particular embodiment being 12.00 inches.

III. Modular Curb Cover Apparatus

Figure 2A:
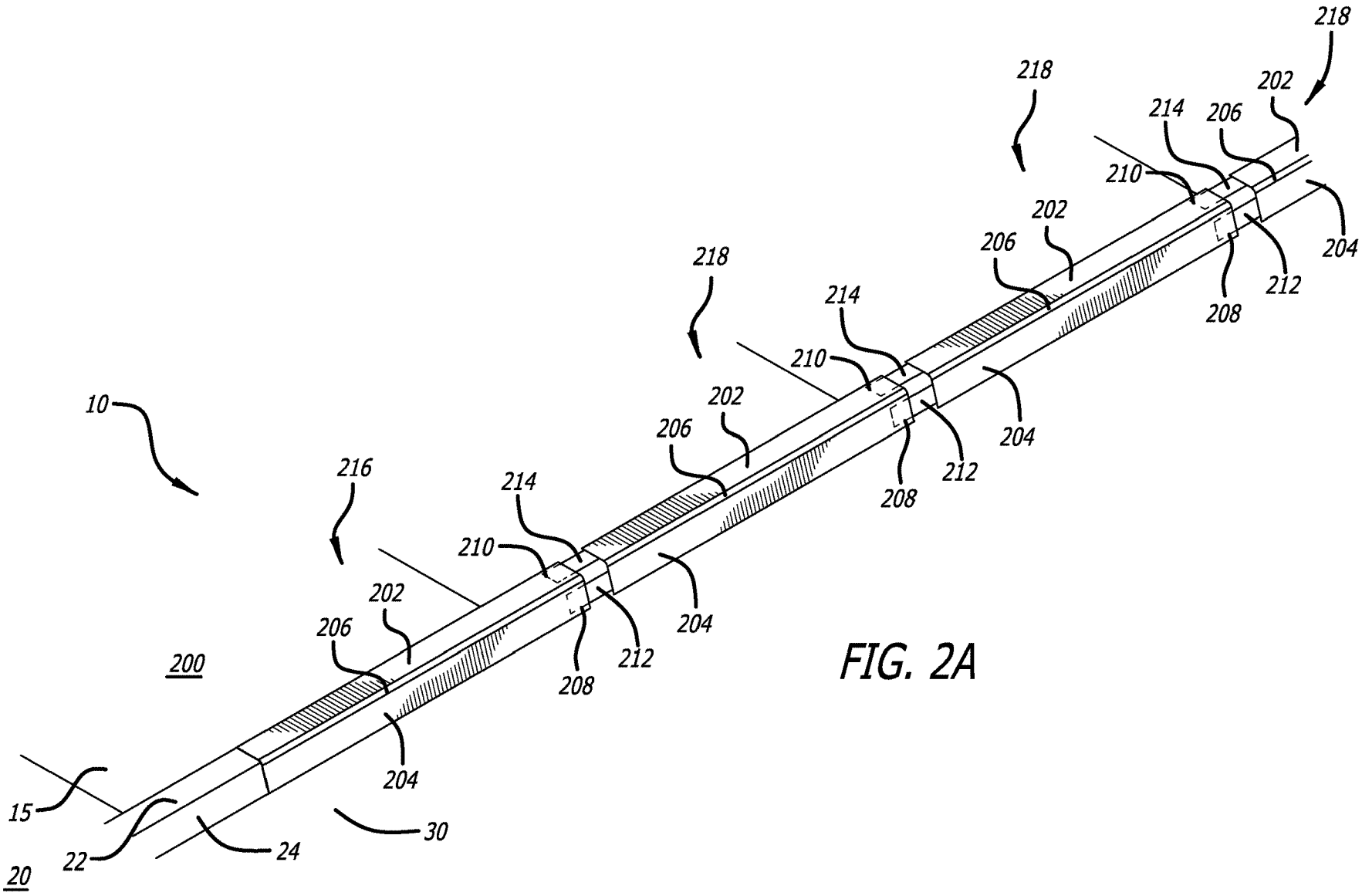
FIG. 2A is a first elevation view of an embodiment of a modular curb cover apparatus disposed on a sidewalk curb and configured to protect the sidewalk curb from damage in accordance with some embodiments.

Referring now to FIG. 2A, a first elevation view of an embodiment of a modular curb cover apparatus disposed on a sidewalk curb and configured to protect the sidewalk curb from damage is shown in accordance with some embodiments. The modular curb cover 200 is shown in the environment and placed on the curb 20 in the same manner as the solid curb cover 100 of FIG. 1A was illustrated being placed thereon. Additionally, the modular curb cover 200 provides the same functionality as the solid curb cover 100; however, the modular curb cover 200 is comprised of a plurality of sectionals including a receiver section 216 and a universal section 218. Each of the receiver section 216 and the universal section 218 includes a top component 202, a front component 204, and a bend (or corner) component 206, which each being comparable to the corresponding components of the solid curb cover 100.

Additionally, each of the receiver section 216 and the universal section 218 includes, disposed at a first end (e.g., the right-hand side in FIG. 2A), a front groove 208 and a top groove 210. Each front groove 208 and top groove 210 is configured to receive a corresponding tongue extending a universal section 218.

More specifically, a receiver section 216 is configured with a front groove 208 and a top groove 210 at a first end while the opposite end is void of either grooves or tongues. In one embodiment, a receiver section 216 may include grooves at both ends. A universal section 218 includes, on the first end, a front groove 208 and a top groove 210 and, on a second end opposite the first end, a front tongue 212 and a top tongue 214. The modular curb cover 200 is comprised of a plurality of sectionals, which typically includes a first receiver section 216 and one or more universal sections 218. To couple a universal section 218 to a receiver section 216, the tongues 212, 214 of the universal section 218 are inserted into the corresponding grooves 208, 210 of the receiver section 216. Similarly, to couple a first universal section 218 to a second universal section 218, the tongues 212, 214 of the first universal section 218 are inserted into the corresponding grooves 208, 210 of the second universal section 218.

FIG. 2A illustrates one embodiment of a modular curb cover 200 comprised of a receiver section 216 and three universal sections 218. However, other embodiments may include an alternative number of universal sections 218, e.g., one, two four, or more. In some embodiments, the receiver section 216 and the universal sections 218 may have the same length that falls within the range of 30.00-40.00 inches, with one particular embodiment being a length of 35.25 inches. The thickness of the components of the curb cover 200 (as well as those embodiments discussed below) may be similar to that of the curb cover 100 and fall within the range of 0.05-1 inch, with one particular embodiment being 0.074 inches.

Figure 2B:
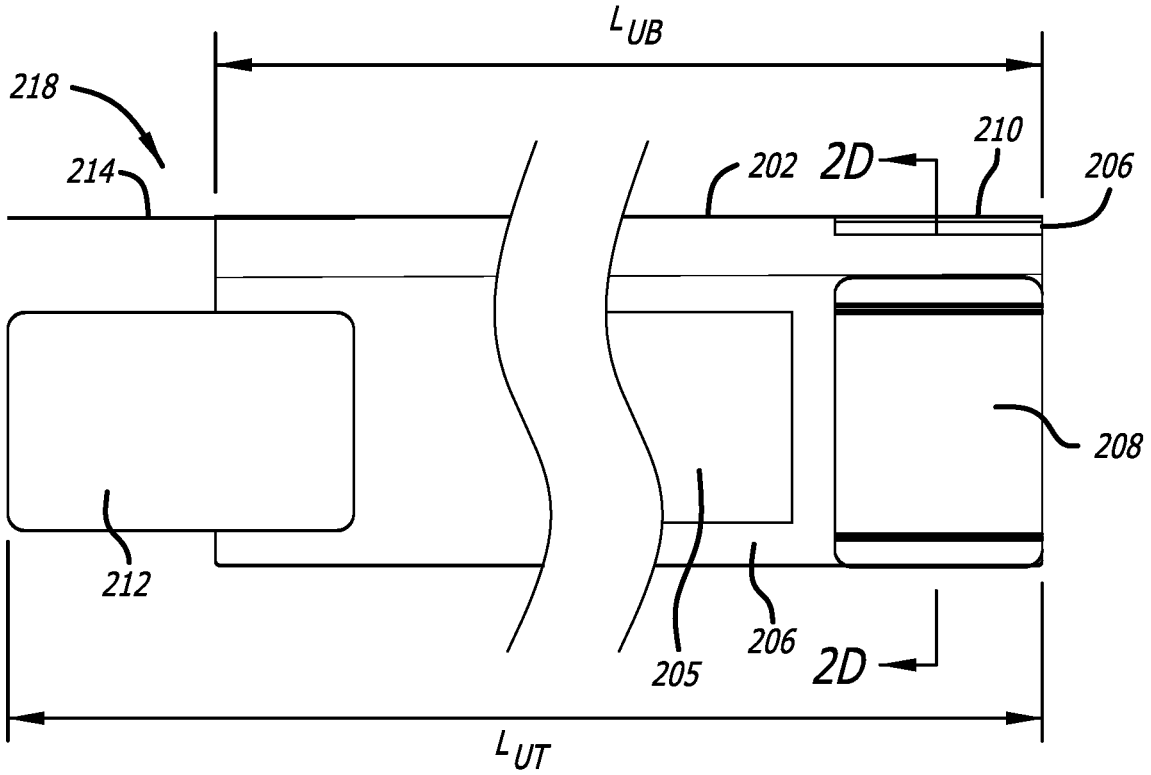
FIG. 2B is a front elevation view of a diagrammatic representation of a universal section of the modular curb cover apparatus of FIG. 2A in accordance with some embodiments.

Referring to FIG. 2B, a front elevation view of a diagrammatic representation of a universal section of the modular curb cover apparatus of FIG. 2A is shown in accordance with some embodiments. The universal section 218 is shown in further detail in FIG. 2B as disclosing the tongues 212, 214 as, in some embodiments, being an additional component that is coupled to a body section (combination of the top component 202, front component 204, and bend component 206). For instance, the tongues 212, 214 may each be formed of 14 gauge cold-rolled steel and welded to the underside of the front component 204 and top component 202 respectively. However, in other embodiments, the tongues, 212, 214 may be coupled to the upper side of the front component 204 and top component 202, and in yet other embodiments, the tongues 212, 214 may be integrally formed with the body section. In some embodiments, the tongues 212, 214 may include rounded corners, which assists with inserting the tongues 212, 214 into corresponding grooves. Rounded corners also reduce a risk of injury when transporting the universal section 218 as compared to tongues have pointed (sharp) corners. In alternative embodiments, other materials may be utilized, such as high-density polyethylene (HDPE) or polyethylene high-density (PEHD) (e.g., a thermoplastic polymer made from petroleum).

Additionally, the tongues 212, 214 may have a length (LT) that extends beyond the distal edge of the front component 204, top component 202, which is greater than the length of the corresponding grooves (LG). For example, the length (LT) may be 3 includes whereas the length (LG) may be 2.00 inches. However, these measurements are merely exemplary and additional embodiments may include a length (LT) of 2.00-4.00 inches and a length (LG) of 1.00-5.00 inches. It is noted that in some embodiments, the length (LG) is greater than or equal to the length (LT).

As discussed with respect to the curb cover 100, in some embodiments, the underside of the curb cover 200 may include protective pads 205 adhesively attached thereto. These pads may assist in vibration and noise isolation when an object (e.g., skateboard, scooter, roller skates, bicycle, or any accessories attached thereto) contacts the exterior facing side of the curb cover 200. The protective pads 205 may be comprised of material such as, but limited or restricted to, textile materials (e.g., from natural fibers such as wool or synthetic fibers such as petroleum-based acrylic or acrylonitrile, or wood pulp-based rayon), or rubber.

Figure 2C:
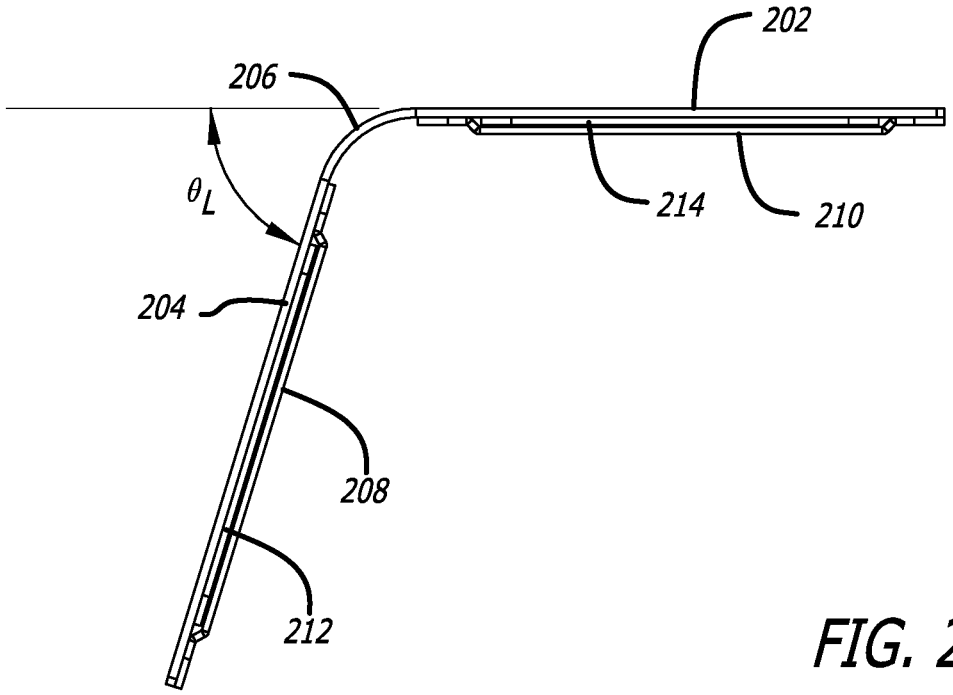
FIG. 2C is a first elevation view of the diagrammatic representation of the universal section of FIG. 2A in accordance with some embodiments.
Figure 2D:
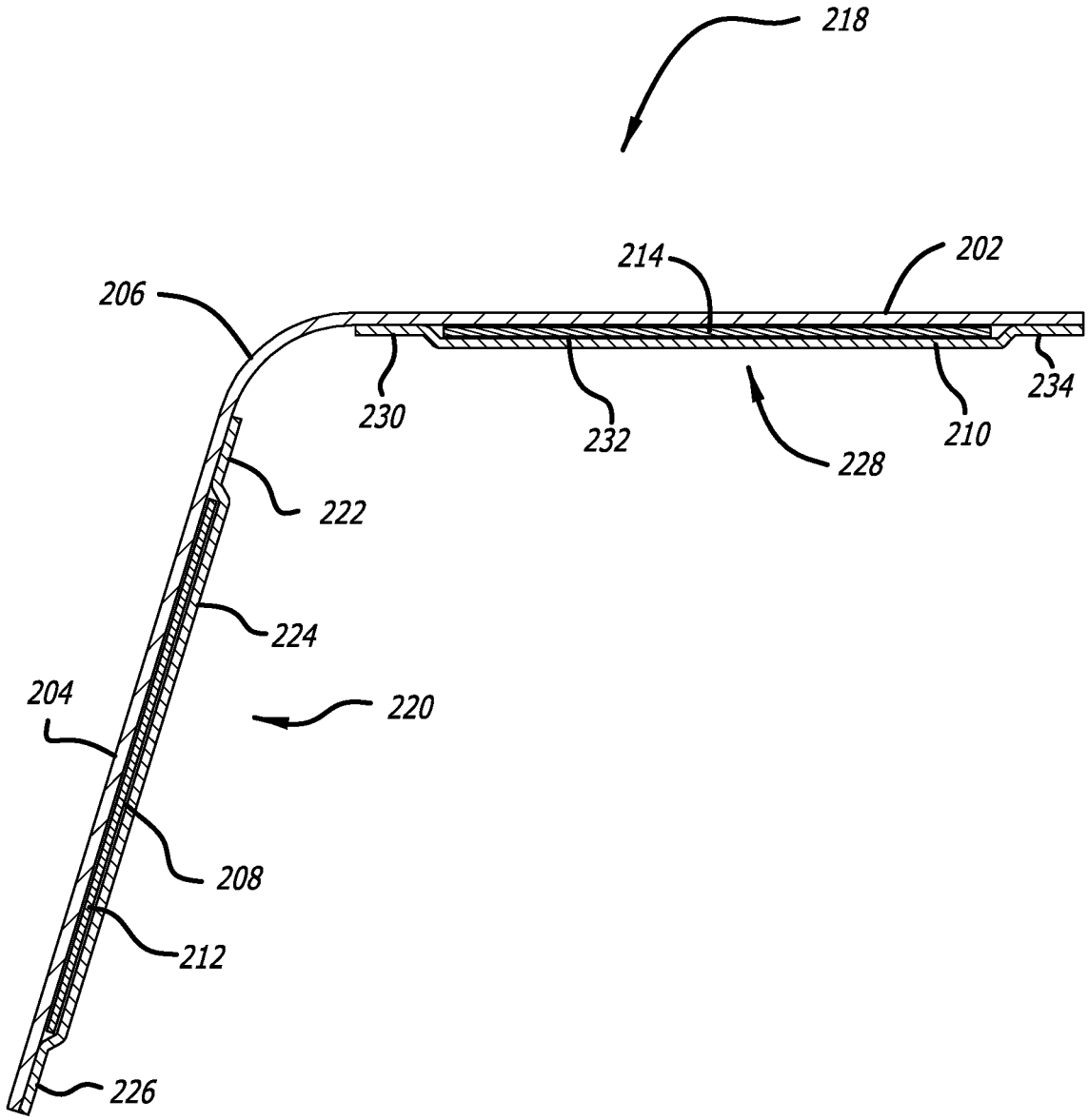
FIG. 2D is a second elevation view of the diagrammatic representation of the universal section of FIG. 2A in accordance with some embodiments.

Referring to FIG. 2C, a first elevation view of the diagrammatic representation of the universal section of FIG. 2A is shown in accordance with some embodiments. FIG. 2C provides further detail of the tongues 212, 214 coupled to the underside of the front component 204 and the top component 202, respectively. Referring now to FIG. 2D, a second elevation view of the diagrammatic representation of the universal section of FIG. 2A is shown in accordance with some embodiments. FIG. 2D provides further detail of the grooves 208, 210. The groove 208 is formed through the coupling of a groove plate 220 to the underside of the front component 204, where the groove plate 220 is comprised of first and second attachment portions 222, 226 disposed on either side of a groove portion 224. The groove plate 220 may be formed of 14 gauge cold-rolled steel and the attachment portions 222, 226 may be welded to the underside of the front component 204. The groove portion 224 may extend out from the underside of the front component 204 a distance that corresponds to the thickness of the tongue 212. In alternative embodiments, other materials may be utilized, such as high-density polyethylene (HDPE) or polyethylene high-density (PEHD) (e.g., a thermoplastic polymer made from petroleum).

The groove 210 is formed through the coupling of a groove plate 228 to the underside of the top component 202, where the groove plate 228 is comprised of first and second attachment portions 230, 234 disposed on either side of a groove portion 232. The groove plate 228 may be formed of 14 gauge cold-rolled steel and the attachment portions 230, 234 may be welded to the underside of the top component 202. The groove portion 232 may extend out from the underside of the top component 202 component a distance that corresponds to the thickness of the tongue 214. In alternative embodiments, other materials may be utilized, such as high-density polyethylene (HDPE) or polyethylene high-density (PEHD) (e.g., a thermoplastic polymer made from petroleum).

Figure 3A:
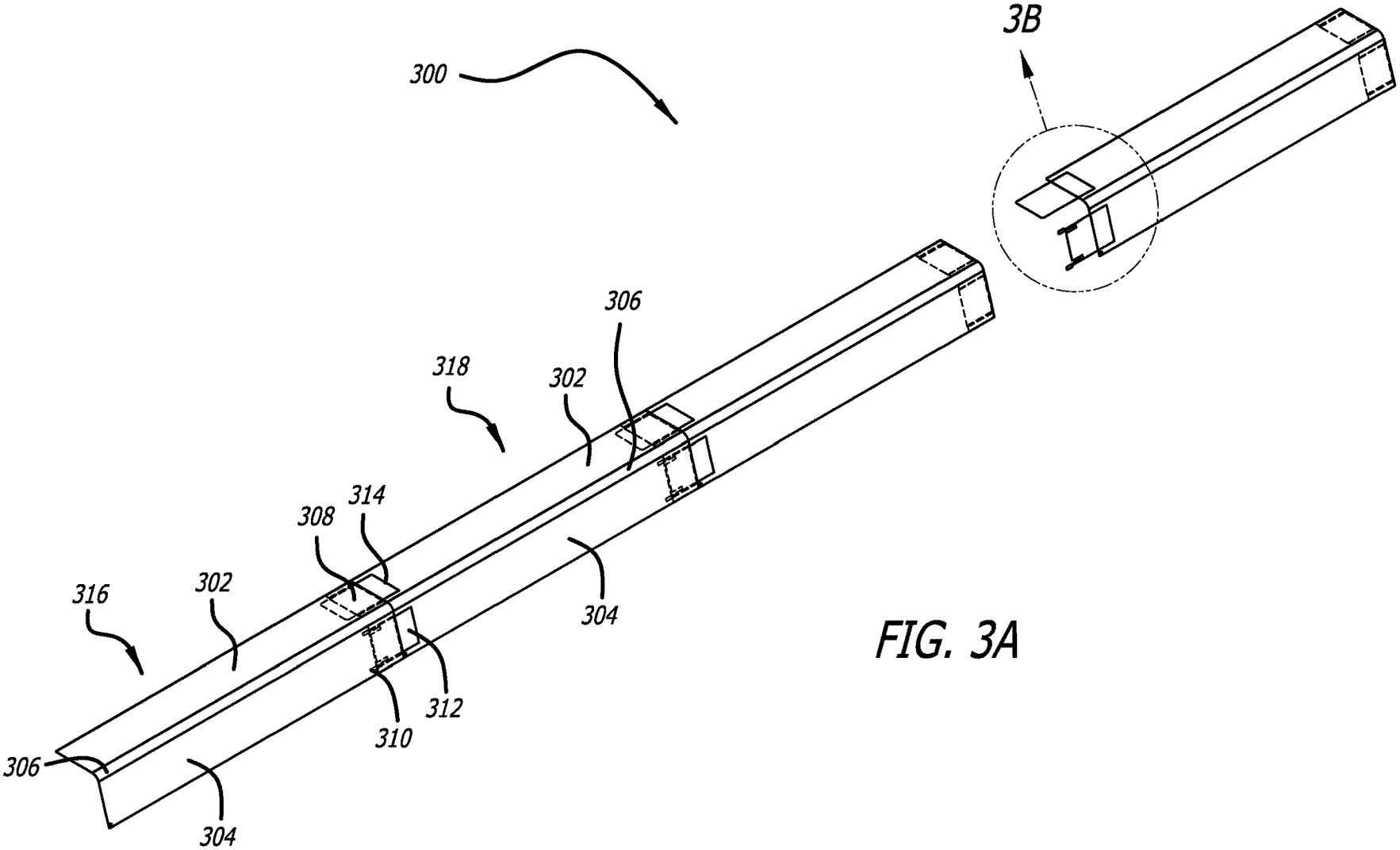
FIG. 3A is a prospective view of a diagrammatic representation of a second embodiment of a modular curb cover apparatus including a tongue having locking tabs in accordance with some embodiments.

Referring now to FIG. 3A, a prospective view of a diagrammatic representation of a second embodiment of a modular curb cover apparatus including a tongue having locking tabs is shown in accordance with some embodiments. The modular curb cover 300 is shown in the environment and placed on the curb 20 in the same manner as the modular curb cover 200 of FIG. 2A was illustrated being placed thereon. Additionally, the modular curb cover 300 provides the same functionality as the modular curb cover 200; however, the tongue 312 of the modular curb cover 300 further includes locking tabs configured to lock the plurality of sectional pieces together. Numerous components, aspects, and features of the modular curb cover 300 are identical or substantially similar to those of the modular curb cover 200, and thus, will not be discussed.

Briefly, the modular curb cover 300 may be comprised of a receiver section 316 and one or more universal sections 318 in the same manner that the modular curb cover 200 may be comprised of a receiver section 216 and one or more universal sections 218. Further, the grooves 308, 310 correspond to the grooves 208, 210.

Figure 3B:
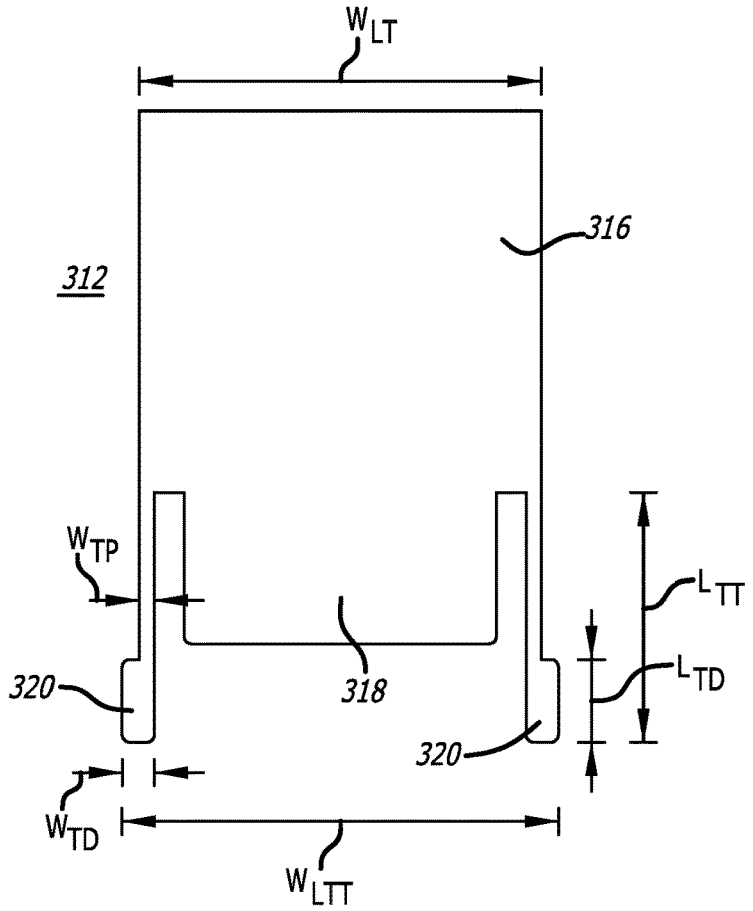
FIG. 3B is a plan view of a diagrammatic representation of a tongue of the modular curb cover apparatus of FIG. 3A including locking tabs in accordance with some embodiments.

Differently, the tongue 312 of the universal components 318 includes locking tabs as opposed to the rounded corners of the tongues 212, 214, where the locking tabs are illustrated in detail in FIG. 3B. In alternative embodiments, the tongue 314 may also include locking tabs. Additionally, in some embodiments, the tongue 314 may include locking tabs while the tongue 312 includes rounded corners similar to the tongue 212.

Referring now to FIG. 3B, a plan view of a diagrammatic representation of a tongue of the modular curb cover apparatus of FIG. 3A that includes locking tabs is shown in accordance with some embodiments. The tongue 312 is shown to include a body section 316, which is configured to couple to the underside of an end of the universal section 318 and partially extend therefrom. The body section 316 terminates at a narrowed distal portion 318 such that locking tabs 320 extend distally from the body section 316 on either side of the distal portion 318. In one embodiment as shown, the locking tabs 320 each include a leg portion that extends directly from the body section 316 and a thicker tab portion at the distal end of the leg portion.

FIG. 3B illustrates several measurement details for the tongue 312 including: a width of the "locking" tongue body ($W_{LTB}$) (e.g., ranging from 3.00-4.00 inches); a width of the total locking tongue body ($W_{LTT}$) (e.g., ranging from 3.5-4.5 inches); a width of the proximal portion of the tab ($W_{TP}$) (e.g., ranging from 0.1-0.2 inches); a width of the distal portion of the tab ($W_{TD}$) (e.g., ranging from 0.2-0.3 inches); a length of the total tab ($L_{TT}$) (e.g., ranging from 1.5-2.5 inches); and a length of the distal portion of the tab (e.g., ranging from 0.5-1.00 inch). These measurement and ranges are illustrative and not intended to be limiting.

Figure 3C:
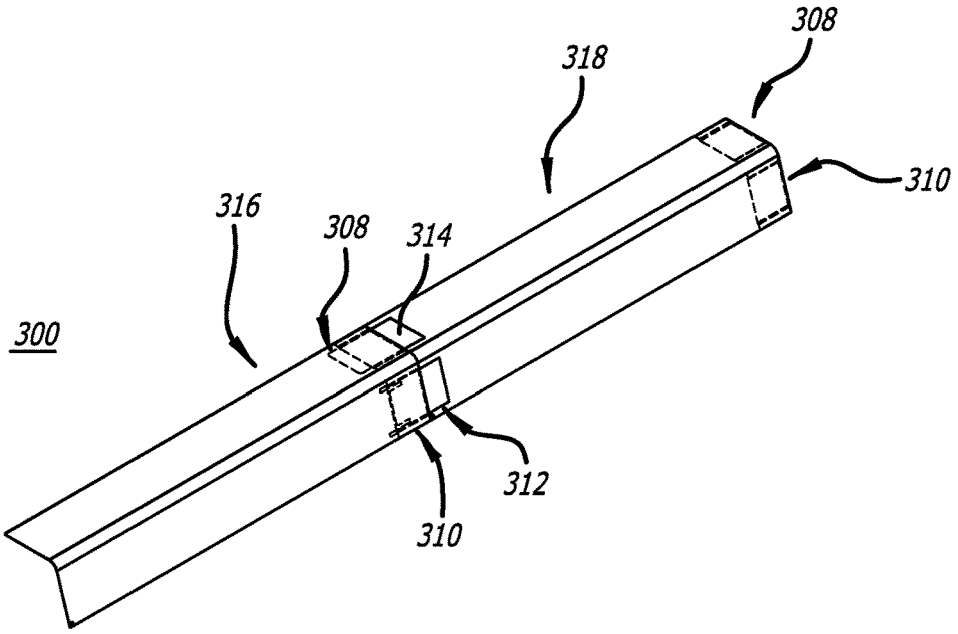
FIG. 3C is a prospective view of a diagrammatic representation of a receiving section coupled to a universal section of the modular curb cover apparatus of FIG. 3A in accordance with some embodiments.

Referring to FIG. 3C, a prospective view of a diagrammatic representation of a receiving section coupled to a universal section of the modular curb cover apparatus of FIG. 3A is shown in accordance with some embodiments. FIG. 3C provides a detailed illustration of the tongue 312 disposed in the groove 310 (e.g., coupled with a corresponding groove plate similar to the front groove plate 222 as shown in FIG. 2D). In order to couple and lock the receiving section 316 and the universal section 318 together, the tongue 312 is slid into groove 310 such that the distal end of the tongue 312 extends through the groove 310 such that the locking tabs 320 pass through groove 310 such that the distal portion of the locking tab catches an edge of a corresponding groove plate (again, see the detail shown in FIG. 2D as the receiving section 316 includes a similar groove plate to form the groove 310). Also shown is the tongue 314 disposed within, and extending through, the groove 308.

III. Ledge Cover Apparatus

Figure 4A:
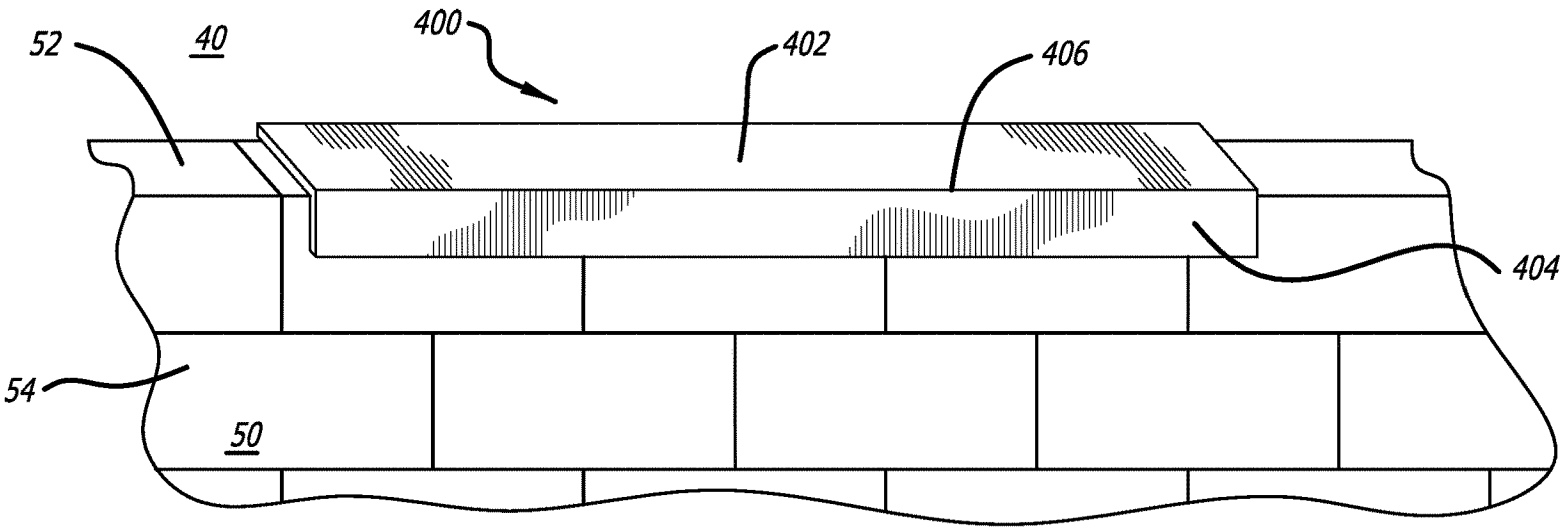
FIG. 4A is a first elevation view of an embodiment of a solid ledge cover apparatus disposed on a ledge and configured to protect the ledge from damage in accordance with some embodiments.

Referring now to FIG. 4A, a first elevation view of an embodiment of a solid ledge cover apparatus disposed on a ledge and configured to protect the ledge from damage is shown in accordance with some embodiments. The solid ledge cover apparatus ("ledge cover") 400 is shown in an environment 40 that includes a ledge 50 and an area 45 adjacent the ledge. The ledge itself includes a top 52 and a front 54. The ledge cover 400 is specifically configured to be placed on the ledge 50 and cover a portion of the top 52 and the front 54.

The ledge cover 400 includes a top component 402, a front component 404 and a bend (or corner) component 406. Each of the components 402, 404, 406 include an upper side (surface or face) that is exterior facing and an underside (surface or face) that is ledge facing. In some embodiments, the ledge cover 400 is formed of 14 gauge cold-rolled steel. Additionally, in some embodiments, the ledge cover 400 is galvanized to protect the apparatus from rusting. In some embodiments, a powder coating finish may be applied to the ledge cover 400, which further reduces the coefficient of friction while providing a visually distinct appearance. The ledge cover 400 may be integrally formed as a single piece of steel. In other embodiments, the ledge cover 400 may be formed of multiples pieces of steel corresponding to the top component 402, the front component 404, and the bend component 406 welded together. In yet other embodiments, the ledge cover 400 may be formed of two pieces of steel corresponding to the top component 402 and the front component 404, where the welding creates bend component 406. In alternative embodiments, other materials may be utilized, such as high-density polyethylene (HDPE) or polyethylene high-density (PEHD) (e.g., a thermoplastic polymer made from petroleum). In some embodiments, the ledge cover 400 may have a length that falls within the range of 48.00-108.00 inches. In some embodiments, the length falls with the range of 84.00-96.00 inches, with one particular embodiment being a length of 92.00 inches.

The ledge cover 400 operates and functions in the same manner as the curb cover 100; however, the ledge cover 400 is configured (e.g., sized and angled) to be disposed on a ledge, which may be an edge where the top component is a 90° angle (or substantially 90° angle) from the front component. For example, referring to FIG. 4A, the ledge 50 may be such that the top 52 is at a 90° angle (or substantially 90° angle) from the front 54. The curb covers 100, 200, 300 are typically formed with a less of an angle between the top component and the front component (e.g., see FIG. 1B where the first angle ($\theta_C$) ranges from 60°-85°, with some embodiments including a range of 70°-75°, and in one embodiment the first angle relative ($\theta_C$) being 75°).

Figure 4B:
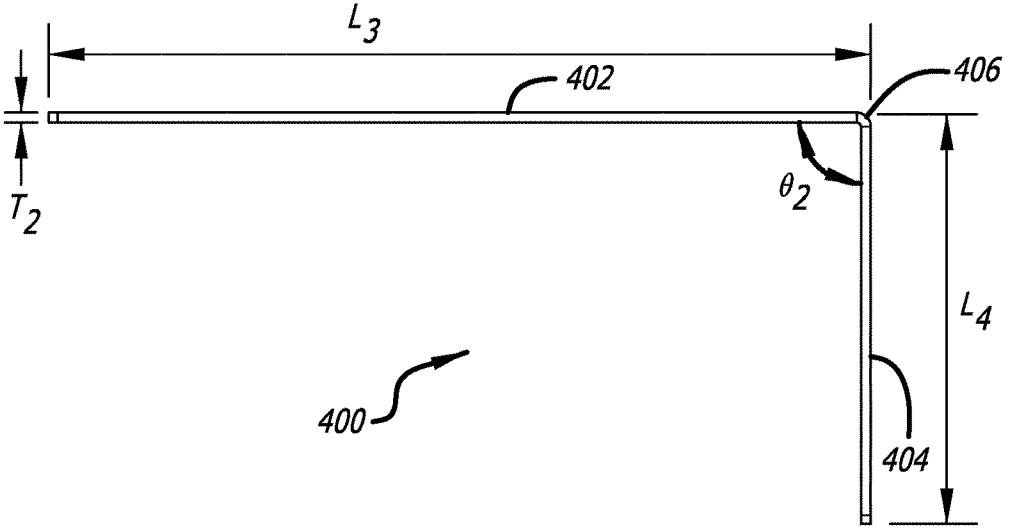
FIG. 4B is a second elevation view of the ledge cover apparatus of FIG. 4A in accordance with some embodiments.

Referring to FIG. 4B, a second elevation view of the ledge cover apparatus of FIG. 4A is shown in accordance with some embodiments. A third length (L3) may be defined from the outer most edge of the top component 402 to a center of the bend component 406, and a fourth length (L4) may be defined from the outer most edge of the front component 404 to the center of the bend component 406. In some embodiments, the first and second lengths may differ where the first length (top) falls within a range of 5.00-9.00 inches and the second length (front) falls within a range of 2.00-5.00 inches. However, in some embodiments, the first and second lengths may be the same and fall within the range of 3.00-6.00 inches. In one embodiment, the first and second lengths may each be 5.00 inches.

As noted above, the ledge cover 400 may be formed such that the front component 404 is positioned at an angle relative to the top component ($\theta_L$). The angle of ledges may vary slightly depending on the location of the ledge. However, in many cases, the angle falls within the range of 80°-90°. Thus, the second angle relative ($\theta_L$) may fall within the range of 80°-90°. In some embodiments, the range may be 85°-80°, with one embodiment the first angle relative ($\theta_L$) being 90°. Further, the top component 402 and the front component 404 may have the same thickness (T2).

Figure 4C:
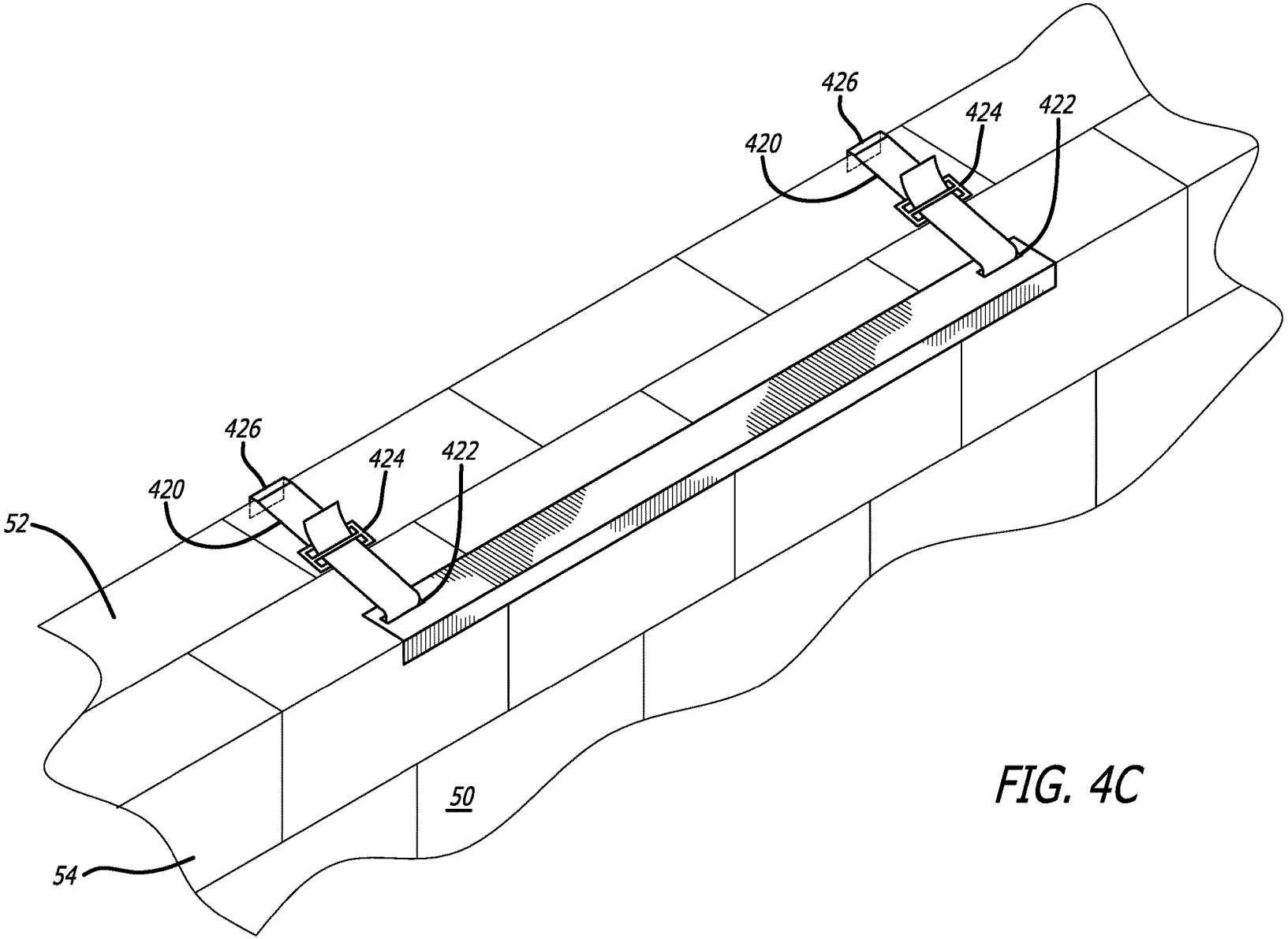
FIG. 4C is a perspective view of the ledge cover apparatus of FIG. 4A including a strap and hook ledge coupler in accordance with some embodiments.

Referring to FIG. 4C, a perspective view of the ledge cover apparatus of FIG. 4A including a strap and hook ledge coupler is shown in accordance with some embodiments. Some embodiments of the ledge cover 400 may include a hook and strap mechanism configured to securely attached the ledge cover 400 to the ledge 50. For example, the hook and strap mechanism may include a strap 425, a buckle 424 and a clip 426. The strap 425 may thread through an opening 422 in the ledge cover 400 and a clip 426 may hook to a backside of the ledge 50 (e.g., opposite the placement of the ledge cover 400). As shown, a plurality of hook and strap mechanisms may be included.

IV. Modular Ledge Cover Apparatus

Figure 5A:
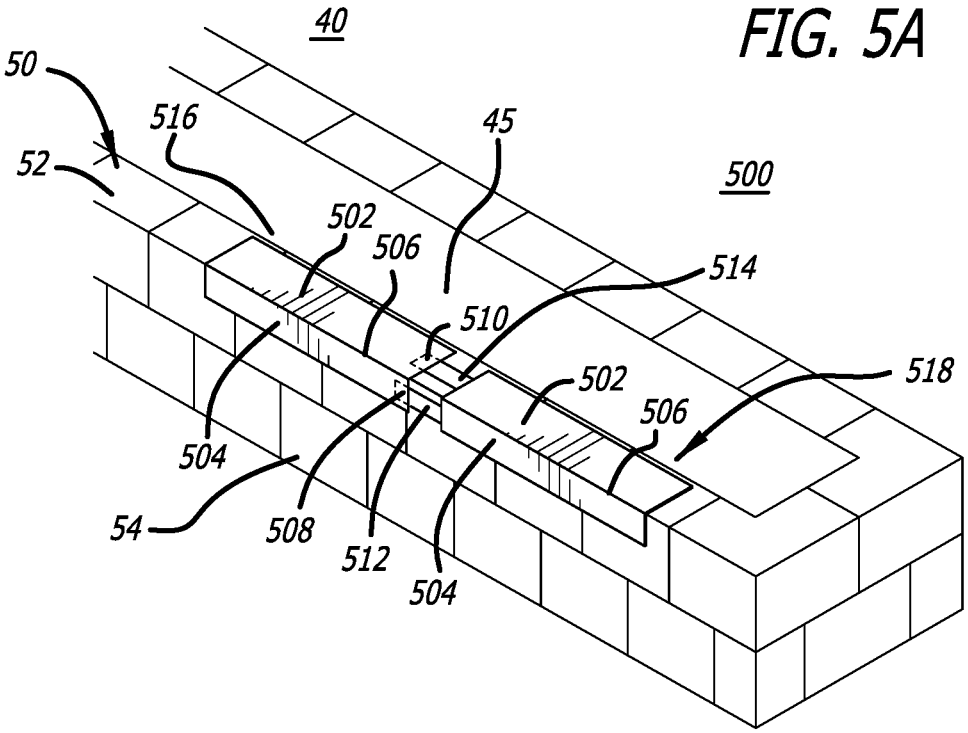
FIG. 5A is a first elevation view of an embodiment of a modular ledge cover apparatus disposed on a ledge and configured to protect the ledge from damage in accordance with some embodiments.

Referring to FIG. 5A, a first elevation view of an embodiment of a modular ledge cover apparatus disposed on a ledge and configured to protect the ledge from damage is shown in accordance with some embodiments. The modular ledge cover 500 is shown in the environment and placed on the ledge 50 in the same manner as the solid ledge cover 400 of FIG. 4A was illustrated being placed thereon. Additionally, the modular ledge cover 500 provides the same functionality as the solid ledge cover 400; however, the modular ledge cover 500 is comprised of a plurality of sectionals including a receiver section 516 and a universal section 518. Each of the receiver section 516 and the universal section 518 includes a top component 502, a front component 504, and a bend (or corner) component 506, which each being comparable to the corresponding components of the solid ledge cover 400. A first length (L1) may be defined from the outer most edge of the top component 502 to a center of the bend component 506, and a second length (L2) may be defined from the outer most edge of the front component 504 to the center of the bend component 506. In some embodiments, the first and second lengths may fall within the range of 3.00-6.00 inches, wherein in one particular embodiment, the first length is 6.00 inches and the second length is 3.00 inches.

Additionally, each of the receiver section 516 and the universal section 518 includes, disposed at a first end (e.g., the right-hand side in FIG. 5A), a front groove 508 and a top groove 510. Each front groove 508 and top groove 510 is configured to receive a corresponding tongue extending a universal section 518.

More specifically, a receiver section 516 is configured with a front groove 508 and a top groove 510 at a first end while the opposite end may be void of either grooves or tongues. In one embodiment, a receiver section 516 may include grooves at both ends. A universal section 518 includes, on the first end, a front groove 508 and a top groove 510 and, on a second end opposite the first end, a front tongue 512 and a top tongue 514. The modular curb cover 500 is comprised of a plurality of sectionals, which typically includes a first receiver section 516 and one or more universal sections 518. To couple a universal section 518 to a receiver section 516, the tongues 512, 514 of the universal section 518 are inserted into the corresponding grooves 508, 510 of the receiver section 516. Similarly, to couple a first universal section 518 to a second universal section 518, the tongues 512, 514 of the first universal section 518 are inserted into the corresponding grooves 508, 510 of the second universal section 518.

FIG. 5A illustrates one embodiment of a modular curb cover 500 comprised of a receiver section 516 and a universal section 518. However, other embodiments may include an alternative number of universal sections 518, e.g., two or more. In some embodiments, the receiver section 516 and the universal sections 518 may have the same length that falls within the range of 30.00-40.00 inches, with one particular embodiment being a length of 35.25 inches.

Figure 5B:
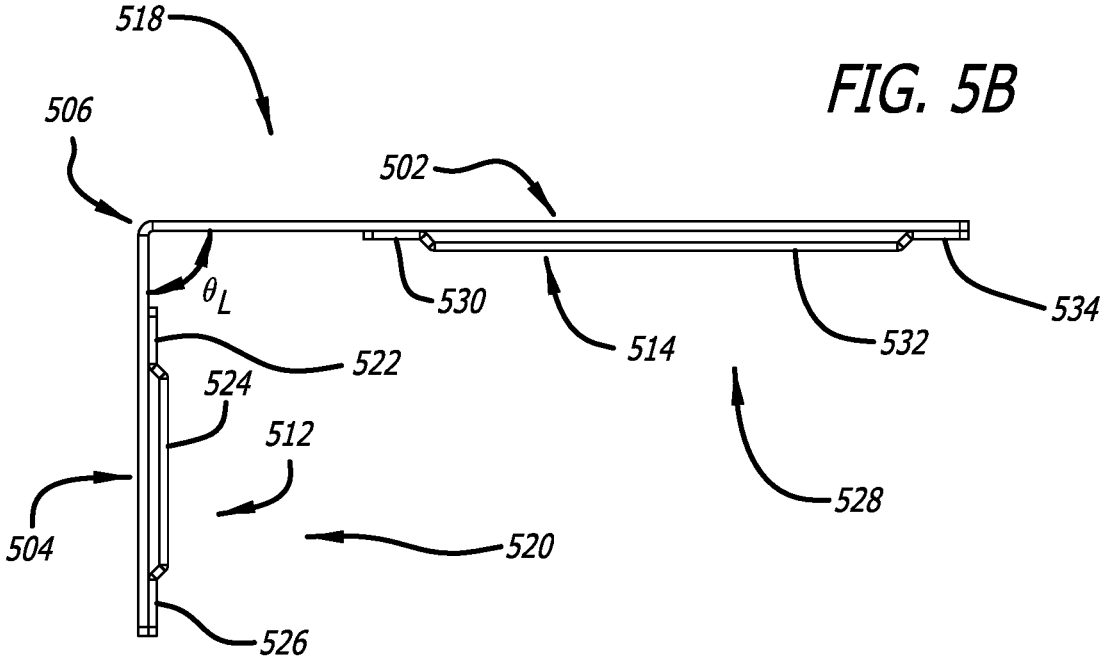
FIG. 5B is a second elevation view of the ledge cover apparatus of FIG. 5A in accordance with some embodiments.

Referring to FIG. 5B, a front elevation view of a diagrammatic representation of a universal section of the modular curb cover apparatus of FIG. 5A is shown in accordance with some embodiments. The universal section 518 is shown in further detail in FIG. 5B as disclosing the tongues 512, 514 as, in some embodiments, being an additional component that is coupled to a body section (combination of the top component 502, front component 504, and bend component 506). For instance, the tongues 512, 514 may each be formed of 14 gauge cold-rolled steel and welded to the underside of the front component 504 and top component 502 respectively. However, in other embodiments, the tongues, 512, 514 may be coupled to the upper side of the front component 504 and top component 502, and in yet other embodiments, the tongues 512, 514 may be integrally formed with the body section. In some embodiments, the tongues 512, 514 may include rounded corners, which assists with inserting the tongues 512, 514 into corresponding grooves. Rounded corners also reduce a risk of injury when transporting the universal section 518 as compared to tongues have pointed (sharp) corners. In alternative embodiments, other materials may be utilized, such as high-density polyethylene (HDPE) or polyethylene high-density (PEHD) (e.g., a thermoplastic polymer made from petroleum). FIG. 5B illustrates that the grooves into which the tongues 512, 514 are inserted are formed by groove plates 520, 528. A first groove is formed through the coupling of a first groove plate 520 to the underside of the front component 504, where the first groove plate 520 is comprised of first and second attachment portions 522, 526 disposed on either side of a groove portion 524. A second groove is formed through the coupling of a second groove plate 528 to the underside of the top component 502, where the second groove plate 528 is comprised of first and second attachment portions 530, 534 disposed on either side of a groove portion 532.

Additionally, the tongues 512, 514 may have a length (LT) that extends beyond the distal edge of the front component 504, top component 502, which is greater than the length of the corresponding grooves (LG). For example, the length (LT) may be 3 includes whereas the length (LG) may be 2.00 inches. However, these measurements are merely exemplary and additional embodiments may include a length (LT) of 2.00-4.00 inches and a length (LG) of 1.00-5.00 inches. It is noted that in some embodiments, the length (LG) is greater than or equal to the length (LT).

V. Block Cover Apparatus

Figure 6A:
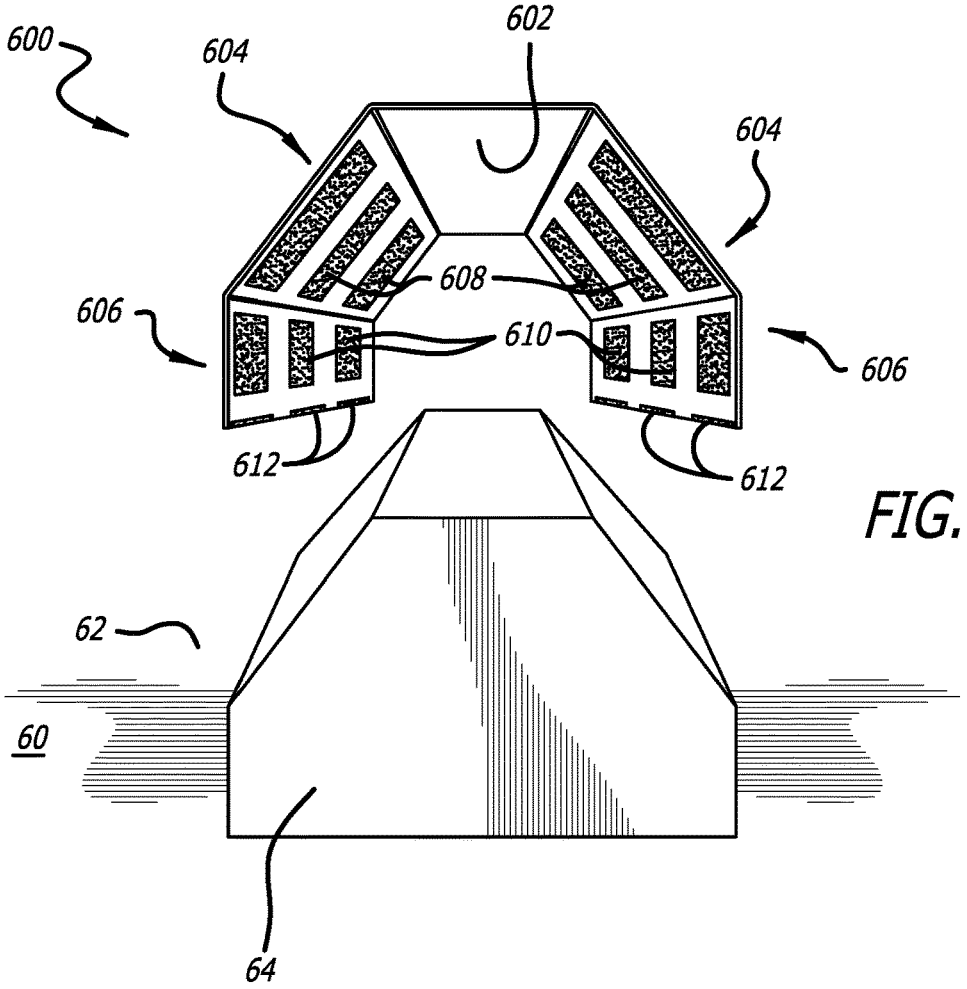
FIG. 6A is an illustration of a block cover apparatus removed from a block in accordance with some embodiments.

Referring now to FIG. 6A, an illustration of a block cover apparatus removed from a block is shown in accordance with some embodiments. The block cover apparatus ("block cover") 600 is shown in an environment 60 that includes a block (e.g., a curb stop or also referred to as a parking block) 64 and a ground area (e.g., a parking lot or concrete area) 62. The block 64 includes a top component, two angled side components and two vertical components. The block cover 600 is specifically configured to be placed on and cover the block 64.

The block cover 600 includes a top component 602, two angled side components 604 and two vertical side components 606. Each of the components 602, 604, 606 include an upper side (surface or face) that is exterior facing and an underside (surface or face) that is block facing. In some embodiments, the block cover 600 is formed of 14 gauge cold-rolled steel. Additionally, in some embodiments, the block cover 600 is galvanized to protect the apparatus from rusting. In some embodiments, a powder coating finish may be applied to the block cover 600, which further reduces the coefficient of friction while providing a visually distinct appearance. The block cover 600 may be integrally formed as a single piece of steel. In other embodiments, the block cover 600 may be formed of multiple pieces of steel (corresponding to one or more of the components 602, 604, 606) welded together. In alternative embodiments, other materials may be utilized, such as high-density polyethylene (HDPE) or polyethylene high-density (PEHD) (e.g., a thermoplastic polymer made from petroleum).

Figure 6B:
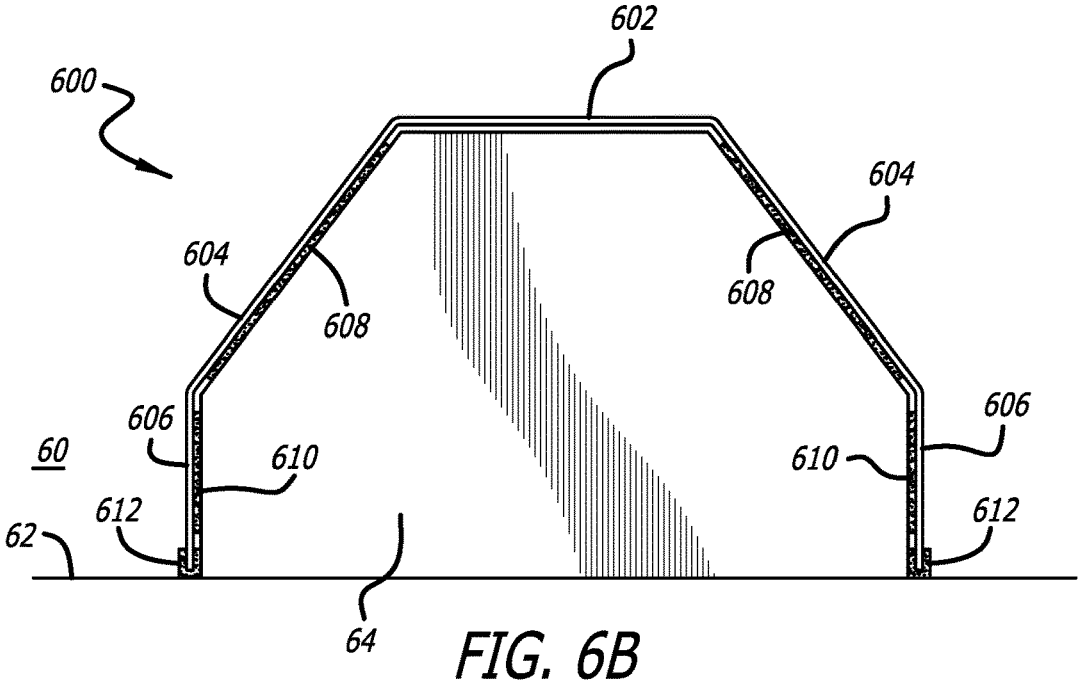
FIG. 6B is an illustration of the block cover apparatus of FIG. 6A disposed on the block in accordance with some embodiments.

In some embodiments, as discussed above, the underside of the block cover 600 may include protective pads 608, 610 adhesively attached thereto. As noted above, these pads may assist in vibration and noise isolation when an object (e.g., skateboard, scooter, or roller skates) contacts the exterior facing side of the block cover 600. The protective pads 608, 610 may be comprised of material such as, but limited or restricted to, textile materials (e.g., from natural fibers such as wool or synthetic fibers such as petroleum-based acrylic or acrylonitrile, or wood pulp-based rayon), or rubber. Additionally, the bottom of the block cover 600 may include one or more rubber liners 612. In some embodiments, a plurality of rubber liners 612 may be disposed on either bottom side (as shown). In other embodiments, each bottom side may only include a single rubber liner 612. Referring to FIG. 6B, an illustration of the block cover apparatus of FIG.

6A disposed on the block is shown in accordance with some embodiments. FIG. 6B illustrates the block cover 600 disposed on top of the block 64. As can be seen, placement of the block cover 600 on the block 64 protects the block 64 from damage when objects directly contact the exterior of the block cover 600 such as skateboards, scooters, roller skates, bicycles, or any accessories attached thereto.

Figure 6C:
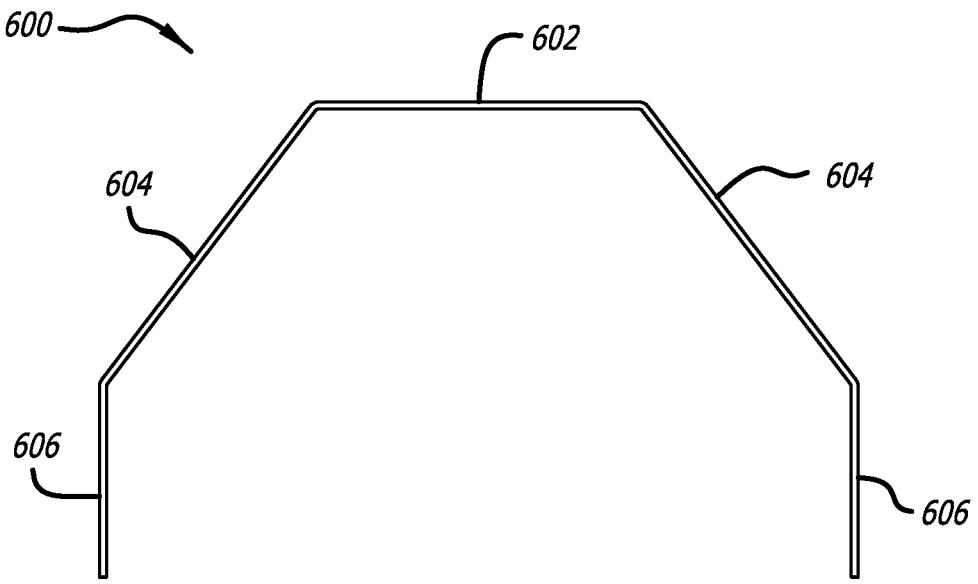
FIG. 6C is a first elevation view of the block cover apparatus of FIG. 6A in accordance with some embodiments.
Figure 6D:
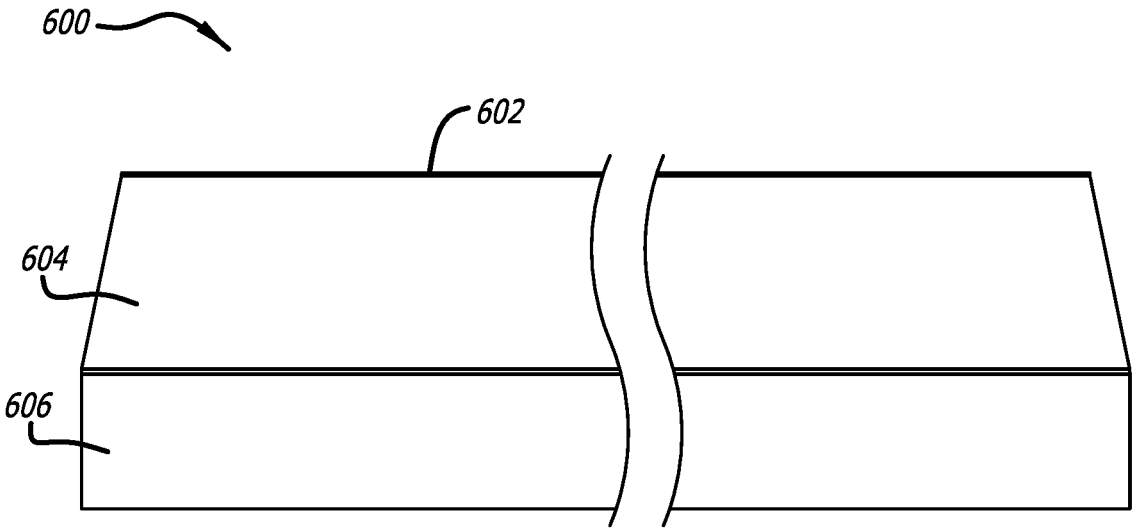
FIG. 6D is a second elevation view of the block cover apparatus of FIG. 6A in accordance with some embodiments.

Referring to FIG. 6C, a first elevation view of the block cover apparatus of FIG. 6A is shown in accordance with some embodiments. FIG. 6C illustrates that the protective pads 608, 610 are optional components. Referring to FIG. 6D, a second elevation view of the block cover apparatus of FIG. 6A is shown in accordance with some embodiments. In some embodiments, the upper portion of the block cover 600 (e.g., the side configured to sit atop the block 64) may have a length that falls within the range of 44.00-48.00 inches, with one particular embodiment being a length of 46.5 inches. In some embodiments, the lower portion of the block cover 600 (e.g., the vertical sides configured to sit adjacent to the ground when disposed on the block 64) may have a length that falls within the range of 46.00-50.00 inches, with one particular embodiment being a length of 47.687 inches. Additionally, the height of the block cover 600 may fall within a range of 4.00-8.00 inches, with one particular embodiment being a length of 4.949 inches.

In the foregoing description, the invention is described with reference to specific exemplary embodiments thereof. However, it will be evident that various modifications and changes may be made thereto without departing from the broader spirit and scope of the invention as set forth in the appended claims.

What is claimed is:

1. An apparatus for providing protection to a curb or a ledge against damage caused by physical contact to the curb or the ledge, the apparatus comprising:

a top component;

a first groove plate formed of a first front flat portion, a first front angled portion, a first rear angled portion, a first rear flat portion, and a first center portion between the first front angled portion and the first rear angled portion, wherein the first front flat portion and the first rear flat portion of the first groove plate are attached to an underside of the top component forming a first groove;

a side component extending from the top component at an angle within an angle range of 60°-90°, wherein the top component and the side component are formed of steel, wherein the top component and side component are configured to be placed on curb or ledge; and a second groove plate formed of a second front flat portion, a second front angled portion, a second rear angled portion, a second rear flat portion, and a second center portion between the second front angled portion and the second rear angled portion, wherein the second front flat portion and the second rear flat portion of the second groove plate are attached to an underside of the side component forming a second groove, and wherein the first groove plate and the second groove plate are attached at a first end of the apparatus.

2. The apparatus of claim 1, wherein the top component and the side component are integrally formed from a single sheet of the steel, and wherein a bend is formed in the single sheet of steel to form the angle between the top component and the side component.

3. The apparatus of claim 1, wherein the angle is 75° or 90°.

4. The apparatus of claim 1, wherein the top component and the side component each have a thickness with a thickness range of 0.05-0.08 inches.

5. The apparatus of claim 4, wherein the top component and the side component each have a length within a length range of 3.00-6.00 inches measured from a center of a bend portion where the side component extends from the top component.

6. The apparatus of claim 4, wherein the top component has a length of 6.00 inches and the side component has a length of 3.00 inches, wherein each length is measured from a center of a bend portion where the side component extends from the top component.

7. The apparatus of claim 1, wherein an underside of at least one of the top component and side component includes a protective pad adhesively attached thereto.

8. The apparatus of claim 1, wherein each of the first groove and the second groove are configured to receive a tongue of a second apparatus resulting in a coupling of the apparatus and the second apparatus.

9. The apparatus of claim 1, wherein a first tongue is attached to the underside of the top component at a second end of the apparatus opposite the first end, and wherein a second tongue is attached to the underside of the side component at the second end of the apparatus.

10. The apparatus of claim 9, wherein the first tongue and second tongue of the apparatus are configured to be received by grooves of a second apparatus.

11. The apparatus of claim 9, wherein at least one of the first tongue and second tongue include one or more locking tabs.

12. The apparatus of claim 1, wherein the apparatus has an overall length within a range of 84.00-96.00 inches.

13. The apparatus of claim 1, wherein the steel is 14 gauge cold-rolled steel.

14. The apparatus of claim 1, wherein the steel is galvanized.

15. The apparatus of claim 1, further comprising:

a hook and strap mechanism configured to securely attach the apparatus to the ledge, wherein the hook and strap mechanism includes a strap, a buckle, and a clip, wherein a length of the strap is adjustable via the buckle.

16. A modular system for providing protection to a curb or a ledge against damage caused by physical contact to the curb or the ledge, the apparatus comprising:

a receiver component including:

a first top component, and a first groove plate formed of a first front flat portion, a first front angled portion, a first rear angled portion, a first rear flat portion, and a first center portion between the first front angled portion and the first rear angled portion, wherein the first front flat portion and the first rear flat portion of the first groove plate are attached to the underside of the first top component forming a first groove at a first end of the receiver component, and a first side component extending from the first top component at an angle within an angle range of 60°-90°, wherein the first top component and the first side component are formed of steel, wherein the first top component and the first side component are configured to be placed on the curb or the ledge, wherein a second groove plate is attached to the underside of the first side component forming a second groove at the first end of the receiver component; and a universal component including:

a second top component, and a second side component extending from the second top component at an angle within an angle range of 60°-90°, wherein the second top component and the second side component are formed of steel, wherein the second top component and the second side component are configured to be placed on the curb or the ledge, wherein a first tongue extends from either the second top component or the second side component at a first end of the universal component, and wherein the first tongue is configured to be received by the first groove thereby coupling the universal component with the receiver component.

17. The system of claim 16, wherein a second tongue extends from the second side component at the first end of the universal component, and wherein the second tongue is configured to be received by the second groove thereby further coupling the universal component with the receiver component.

18. The system of claim 16, wherein the angle is 75° or 90°, and wherein the receiver component and the universal component each have a thickness with a thickness range of 0.05-0.08 inches.

19. The system of claim 18, wherein either:

the first top component, the first side component, the second top component, and the second side component each have an equal length, or the first top component and the second top component have a first length, and the first side component and the second side component have a second length different than the first length.

20. The system of claim 16, wherein an underside of each of the receiver component and the universal component includes a protective pad adhesively attached thereto.

* * * * *